US008382428B2

(12) United States Patent
Frees et al.

(10) Patent No.: US 8,382,428 B2
(45) **Date of Patent: *Feb. 26, 2013**

(54) CENTRIFUGAL WATER PUMP

(75) Inventors: Robert W. Frees, Olmsted Falls, OH (US); Stephen F. Therrien, Twinsburg, OH (US)

(73) Assignee: VRC, Inc., Berea, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/973,294

(22) Filed: Dec. 20, 2010

(65) Prior Publication Data

US 2011/0091319 A1 Apr. 21, 2011

Related U.S. Application Data

(63) Continuation of application No. 11/739,417, filed on Apr. 24, 2007, now Pat. No. 7,878,757, which is a continuation-in-part of application No. 11/687,316, filed on Mar. 16, 2007, now abandoned.

(51) Int. Cl.
*F04D 29/046* (2006.01)
*F04D 29/10* (2006.01)

(52) U.S. Cl. ..... 415/206; 415/229; 415/232

(58) Field of Classification Search ..... 415/206, 415/229, 231; 416/204 R; 277/372, 373, 277/405; 384/480, 484, 486
See application file for complete search history.

(56) References Cited

U.S. PATENT DOCUMENTS

| | | | | |
|---|---|---|---|---|
| 2,203,525 | A * | 6/1940 | Dupree, Jr. | 384/142 |
| 2,989,925 | A | 6/1961 | Brehm et al. | |
| 3,796,507 | A | 3/1974 | Smykal et al. | |
| 3,838,901 | A * | 10/1974 | Sampatacos | 384/481 |
| 3,887,200 | A | 6/1975 | Engelking et al. | |
| 4,172,310 | A * | 10/1979 | Mincuzzi | 29/888.024 |
| 4,328,973 | A | 5/1982 | Delbridge | |
| 4,925,366 | A | 5/1990 | Dorski | |
| 4,966,572 | A | 10/1990 | Kimura et al. | |
| 5,217,350 | A | 6/1993 | Kimura et al. | |
| 5,347,801 | A | 9/1994 | McIlwain | |
| 5,409,350 | A | 4/1995 | Mitchell | |
| 5,529,315 | A | 6/1996 | Borino et al. | |
| 5,580,834 | A | 12/1996 | Pfaff | |
| 5,656,563 | A | 8/1997 | Chen et al. | |
| 5,690,433 | A | 11/1997 | Hans et al. | |

(Continued)

FOREIGN PATENT DOCUMENTS

| | | |
|---|---|---|
| EP | 1698771 | 9/2006 |
| WO | 2008/115730 | 9/2008 |

OTHER PUBLICATIONS

International Search Report and Written Opinion, Aug. 12, 2008.

(Continued)

*Primary Examiner* — Ninh H Nguyen
(74) *Attorney, Agent, or Firm* — Hahn Loeser & Parks LLP

(57) ABSTRACT

A centrifugal water pump for use in a diesel engine cooling system provides an improved water pump construction including multiple features which combine to provide increased operating life for the supporting and wearing components of the pump. The improvements include one or more of: a water seal system is provided having a stationary seal and a rotating seal made of silicon carbide with at least one of the seals having embedded lubricant; an o-ring added to the stationary seal ensures that pressurized water does not get past the stationary seal; metallic bearing seals and covers to prevent leeching of the lubricant from the bearing; optimized spring force on the rotating seal; tapered shaft impeller interface to minimize torsional stresses on these components from the keyway design of the prior art; and the housing engine oil inlet is removed to prevent the direct flow of hot, dirty, and contaminated oil from damaging the water pump bearings.

14 Claims, 3 Drawing Sheets

U.S. PATENT DOCUMENTS

| | | | | |
|---|---|---|---|---|
| 5,707,567 | A | 1/1998 | Pfaff | |
| 5,713,719 | A | 2/1998 | Fiore et al. | |
| 5,947,611 | A | 9/1999 | Nagase | |
| 5,968,653 | A | 10/1999 | Coppella et al. | |
| 5,976,429 | A | 11/1999 | Chen et al. | |
| 6,074,554 | A | 6/2000 | Ray et al. | |
| 6,398,991 | B1 | 6/2002 | Brazil et al. | |
| 6,774,073 | B2 | 8/2004 | Wilkins | |
| 6,884,022 | B2 | 4/2005 | Albright et al. | |
| 6,918,746 | B2 | 7/2005 | Duerr et al. | |
| 6,929,449 | B2 | 8/2005 | Zagone et al. | |
| 7,015,165 | B2 | 3/2006 | Wilkins | |
| 7,878,757 | B2 * | 2/2011 | Therrien et al. | 415/206 |
| 2006/0119049 | A1 | 6/2006 | Feigl et al. | |

OTHER PUBLICATIONS http://news.thomasnet.com/fullstory/483603, Jan. 24, 2007.

* cited by examiner

CENTRIFUGAL WATER PUMP

This application is a continuation of co-pending U.S. patent application Ser. No. 11/739,417, filed Apr. 24, 2007, which is a continuation-in-part of U.S. patent application Ser. No. 11/687,316, filed Mar. 16, 2007, and now abandoned, the disclosures of both of which are hereby incorporated by reference.

BACKGROUND OF THE DISCLOSURE

This invention relates to water pumps of the centrifugal impeller type intended primarily for use in diesel engine cooling systems, especially for railroad locomotives, but also useful for other purposes.

It is known in the art relating to diesel engine cooling systems to provide an engine with one or more centrifugal water pumps, each having a centrifugal flow or mixed flow impeller carried on a shaft and driven by a drive gear or other drive means. The shaft is supported on spaced sealed bearings carried in a housing with back-up or additional lubrication by oil flow from the associated engine oil system. Both ball and roller bearings have been used in the past to carry rotary support loads and axial thrust forces acting on the shaft.

Existing water pumps have a typical life expectancy of about two to three years with the primary failure modes being bearing failure and seal failure. The bearing failures are typically caused by either loss of bearing lubrication, contamination of the bearing lubrication, or leakage of water into the bearing compartments. The seal failure mode is typically caused by failure of the rotating water seal spinning against the stationary seal component on the impeller side of the pump.

In order to prevent the escape of pressurized water from the impeller end of the pump into the oil lubricated portions of the pump, a specific prior art pump system utilizes an antimony carbon seal spinning against a stationary metallic bushing. Both the antimony carbon seal and the metallic bushing are relatively soft materials prone to wear and exhibit problems maintaining a secure leak proof seal in a water pump function. Although these materials have historically been part of pump designs, they have not been able to meet the extended life expectations of pumps in modern mechanical systems.

At least one prior art water pump has attempted to increase the life of the water pump by ensuring that a sufficient supply of oil is provided to the bearings. In this prior art water pump (not shown), the bearings of the water pump are lubricated by grease in the bearings and within the housing by oil delivered through a feed passage. The passage receives lubricating oil from a lubricated portion of an associated engine on which the pump is mounted and directs the oil into an annular chamber or enclosure from which it may lubricate both bearings. Excess oil in the enclosure can escape either by passing through the drive bearing into the adjacent engine enclosure or by passing through the impeller bearing into an annular collector groove. The groove connects with a drain line or passage that carries oil from the collector groove back to the associated engine oil system for return to the engine sump. An oil control combines an oil slinger, a stationary deflector and a lip oil seal with a return passage to the engine to prevent oil from escaping from the bearing enclosure into the water side of the pump housing. However, this prior art pump does not prevent contamination and heat in the engine oil from adversely affecting the bearing life of the pump.

Another problem with the prior art pumps is the mechanical failure of the shaft and impeller caused by torsional stresses along the keyway slots formed in each to allow the keyway to secure the impeller to the shaft.

SUMMARY OF THE DISCLOSURE

The present invention provides an improved water pump construction including multiple features which combine to provide increased operating life for the supporting and wearing components of the pump. At least one embodiment provides a water pump of the centrifugal type adapted for use in diesel engine cooling systems, the water pump comprising: a housing containing a shaft rotatable on an axis extending through the housing, the shaft mounting a drive member adjacent a drive end of the housing and a fluid impeller at an opposite impeller end of the housing; a volute connected with the impeller end of the housing for receiving pressurized water from the impeller; a rotating seal member mounted on the shaft and rotating with the shaft; and a stationary seal member mounted on a holder member, the holder member affixed to the housing; the stationary seal and the rotating member are made of silicon carbide and at least one of the stationary seal and the rotating seal is impregnated with lubricant material.

At least one embodiment of the invention provides a water pump of the centrifugal type adapted for use in diesel engine cooling systems, the water pump comprising: a housing containing a shaft rotatable on an axis extending through the housing, the shaft mounting a drive member adjacent a drive end of the housing and a fluid impeller at an opposite impeller end of the housing; a volute connected with the impeller end of the housing for receiving pressurized water from the impeller; a rotating seal member mounted on the shaft and rotating with the shaft; a stationary seal member mounted on a holder member, the holder member affixed to the housing; the stationary seal and the rotating member are silicon carbide and at least one of the stationary seal and the rotating seal is impregnated with lubricant material; a pin coupling the stationary seal to the holder member; and an o-ring seal positioned between the stationary seal and the holder member.

Another embodiment of the invention provides a water pump of the centrifugal type adapted for use in diesel engine cooling systems, the water pump comprising: a housing containing a shaft rotatable on an axis extending through the housing, the shaft mounting a drive member adjacent a drive end of the housing and a fluid impeller at an opposite impeller end of the housing; a volute connected with the impeller end of the housing for receiving pressurized water from the impeller; a rotating seal member mounted on the shaft and rotating with the shaft; and a stationary seal member mounted on a holder member, the holder member affixed to the housing; the shaft comprises a tapered circumferential portion and the impeller comprises a corresponding tapered aperture, the connection of the impeller to the shaft does not include a keyway to secure the impeller to the shaft.

These and other features and advantages of the invention will be more fully understood from the following description of certain specific embodiments of the invention taken together with the accompanying drawings.

DETAILED DESCRIPTION OF THE DRAWINGS

Figure 1:
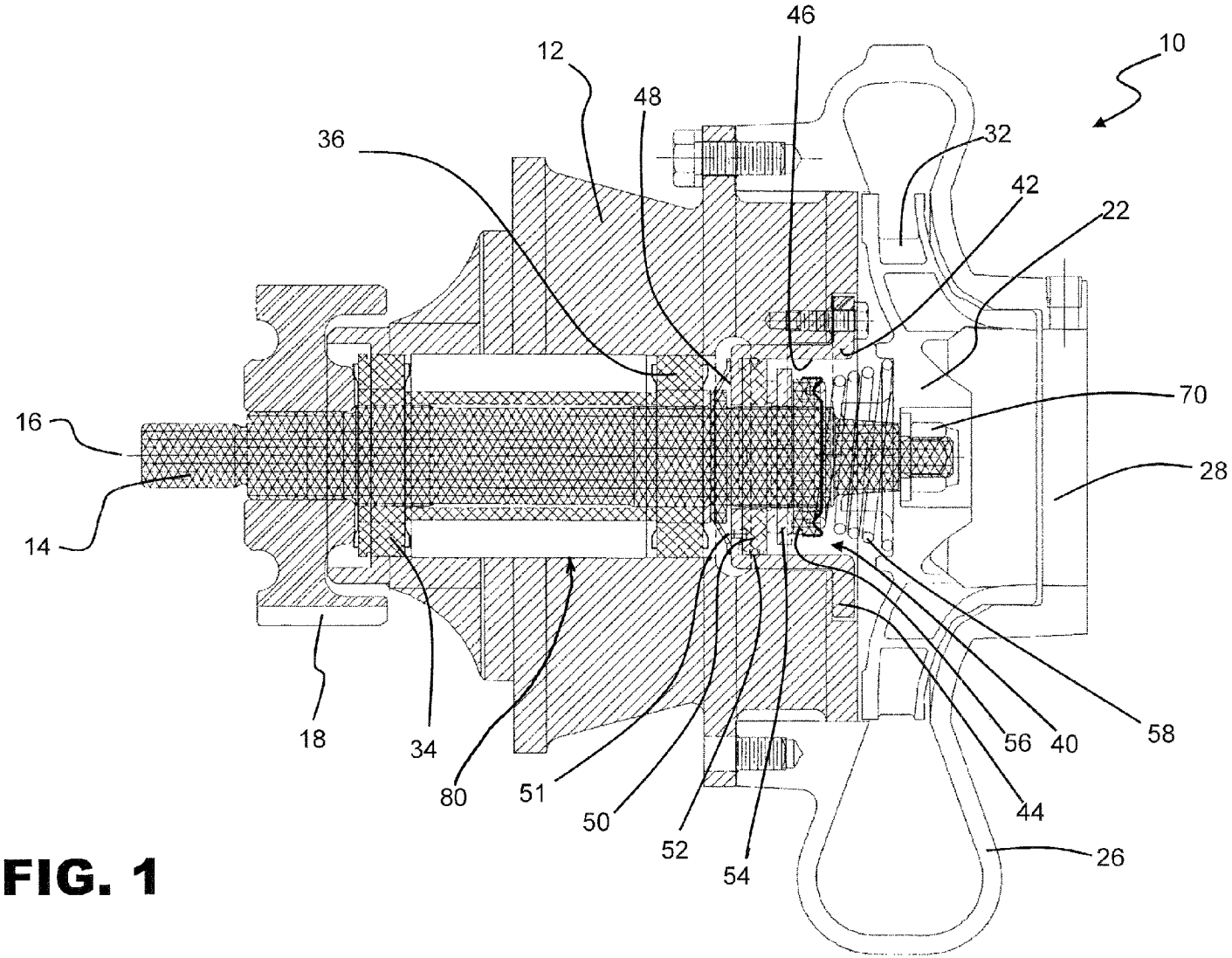
FIG. 1 is a cross-sectional view of an embodiment of the water pump assembly of the invention.

Referring now to FIG. 1, numeral 10 generally indicates a water pump of the centrifugal type adapted for use in diesel engine cooling systems or other suitable applications. Pump 10 includes a housing 12 containing a shaft 14 rotatable on an axis 16 extending through the housing 12. The shaft 14 mounts a drive member in the form of a gear 18 that is carried adjacent a drive end of the housing 12.

A centrifugal impeller 22 is mounted on an opposite end of the shaft 14 adjacent an impeller end of the housing 12. The impeller 22 is contained within a volute 26 that is carried on the impeller end of the housing 12. The volute 26 includes an axial inlet opening 28 and a radial outlet to direct water or other coolant into vanes 32 of the impeller 22. The vanes 32 draw the water axially into the impeller 22 and expel the water radially into the associated volute 26 for discharge to an external cooling system (not shown).

The pump shaft 14 is supported in the housing 12 by a pair of axially-spaced bearings including a drive bearing 34 and an impeller bearing 36 positioned in a bearing housing portion 80. The drive bearing 34 is designed to accept major rotational loads applied to the gear 18 as well as primary thrust loads resulting primarily from the axial flow of the water drawn in by the water pump 10 and expelled radially. The impeller bearing 36 carries primarily centrifugal loads from the impeller 22.

Figure 2:
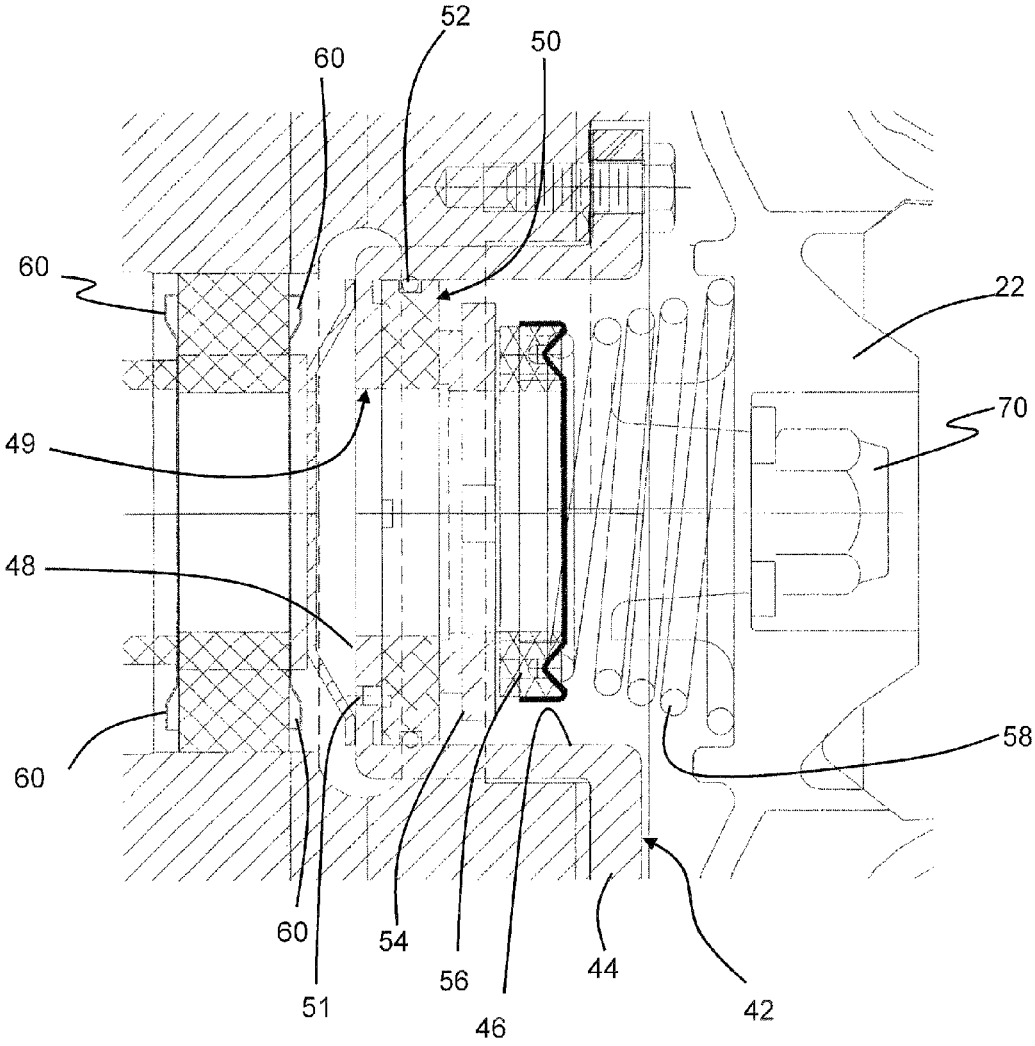
FIG. 2 is a partial, detail, cross-sectional view of the water seal assembly of the water pump of FIG. 1 shown with the axle removed for clarity.

As shown in FIG. 1 and in greater detail in FIG. 2, pump 10 comprises a water seal assembly 40. The water seal assembly 40 comprises a holder member 42 mounted to the housing 12 at a flange 44 of the holder member 42. The holder member 42 includes a cylindrical portion 46 adjacent the flange 44 and a radial wall 48 at an end of the cylindrical portion 46, the radial wall 48 having an aperture 49 for the shaft 14 to extend through. Seal assembly 40 further comprises an annular stationary seal member 50 positioned against the radial wall 48 and the interior of the cylindrical portion 46 of the holder member 42. In one embodiment of the invention, an o-ring 52 is positioned between the stationary seal member 50 and the interior surface of the cylindrical portion 46 of the holder member 42. In one embodiment, the o-ring 52 is made of Viton, graded to both withstand temperatures inherent in the unique pump applications and to deliver a long life expectancy. This configuration provides added protection from leakage of water past the stationary seal 50. The water seal assembly 40 further includes a rotatable water seal member 54 mounted on the shaft 14 and positioned adjacent the stationary seal 50. The rotatable water seal member 54 is also adjacent a shaft seal 56 which may be made of Viton or any other suitable material. A conventional coil spring 58 extends between the impeller 22 and the shaft seal 56 and biases the rotatable water seal member 54 against the stationary seal 50 to maintain a positive seal against leakage. The shaft seal 56, rotatable water seal 54, and spring 58 rotate with the shaft while the stationary seal 50 and holder member 42 remain stationary with the housing 12. In one embodiment of the invention, a pin 51 extending from the radial wall 48 engages an aperture in the stationary seal 50 to prevent rotation of the stationary seal 50.

The water seal assembly 40 prevents water flow from the water side of the pump 10 into the lubricated areas at the drive end of the housing 12. In accordance with one embodiment of the invention, the rotating seal 54 and the stationary seal 50 are both made of silicon carbide and at least one of the rotating seal 54 and the stationary seal 50 are made of silicon carbide impregnated, or embedded, with lubricant material, including for example but not limited to, one or more of graphite, boron nitride, molybdenum disulfide, or other lubricant materials. Alternately or in addition, at least one of the rotating seal 54 and the stationary seal 50 may be coated with lubricant material, including for example but not limited to, one or more of graphite, boron nitride, molybdenum disulfide, or other lubricant materials. Silicon carbide is a hard material which can be fabricated to extremely flat surfaces which helps provide a good seal. Silicon carbide is also not prone to excessive wear which extends the life expectancy of the seal over current designs. In addition, silicon carbide acts as a cutting agent. The interface between the rotating and stationary seal faces is exposed to water on the outside circumference, therefore foreign materials passing through the water system of the pump 10 are ground up at the edges of the rotating seal ring 54 and do not compromise the seal assembly 40. At least one of the rotating seal 54 and the stationary seal 50 includes embedded lubricant which provides a lubricating layer between the seals 50, 54. The embedded lubricant prevents the situation of rotating silicon carbide against silicon carbide as such would cause the seals 50, 54 to cut into each other resulting in premature wear and the generation of excessive heat. In the embodiment shown, the rotating seal 54 has a flanged outer diameter that is designed for added structural strength. The rotating seal 54 is formed having a recessed outer diameter and inner diameter that reduces the contact area with the stationary seal 50.

Another problem with the prior art pumps is related to the preload on the spring 58. The prior art system uses a spring preload of twenty pounds. This preload level puts excessive load on the seal package, adding to the excessive wear and shortened life expectancy of the pump. Optimizing the spring tension in the seal compartment is a component of achieving the goal of a water pump with an extended life expectancy. By using a material such as silicon carbide/silicon carbide embedded with lubricant material, the decrease in wear requires less spring travel with better sealing materials and accordingly less force is sufficient.

As previously discussed, the support housing of some prior art water pumps has an inlet that allows engine oil to enter the interior of the support housing. The engine oil is hot and typically includes dirt and other contaminants. The bearings are protected from the oil by non-metallic side seals. The hot and dirty engine oil attacks the non-metallic side seals on each of the ball bearings at the two ends of the cavity. The breakdown of the side seals on the bearings enables the lubricating grease in the ball bearing to leech out. Without the lubricating grease, the bearing metallic components show accelerated wear and early failure. With particular respect to the bearing on the impeller side of the pump, this failure mode also enables the water jacket of the pump to be compromised resulting in oil in the engine cooling water and/or pump leakage in engine compartment or the surrounding environment. In one embodiment of the invention, the bearing housing portion 80 of the support housing 12 does not include an inlet for engine oil, or for retrofit of existing pumps, the oil inlet is plugged (not shown). In this embodiment, the bearing housing portion 80 is adapted to prevent engine oils from entering the bearing housing portion 80. The removal or plugging of the inlet prevents hot and dirty engine oil from entering the bearing compartment and potentially damaging the bearings.

Figure 3:
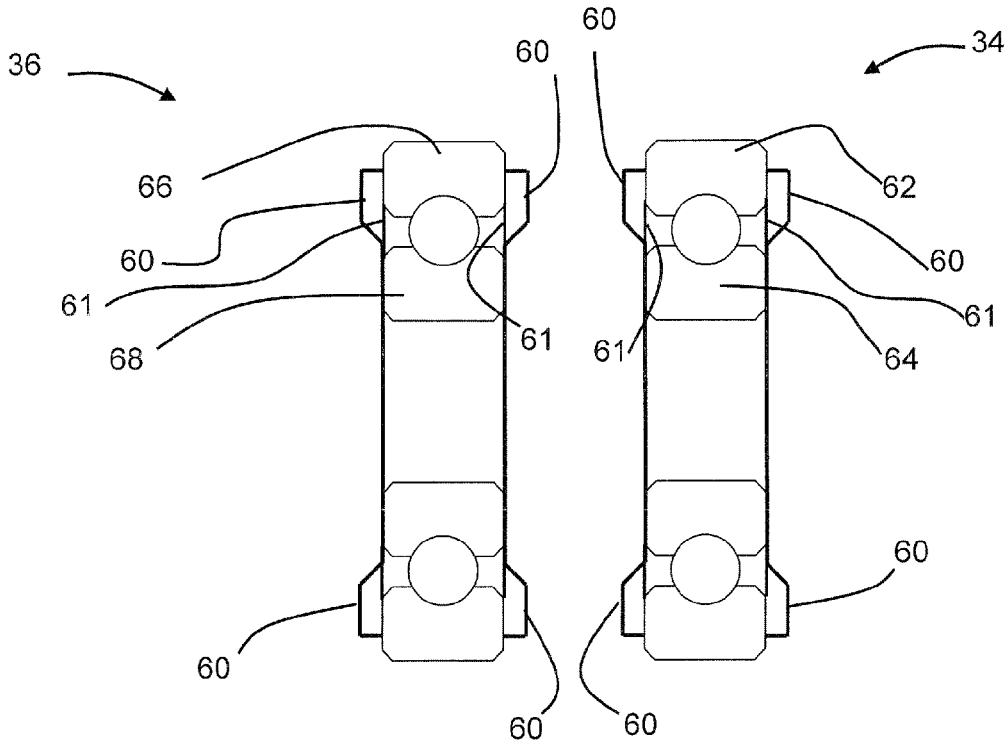
FIG. 3 is a cross-sectional view of the impeller bearing and the drive bearing shown with metallic seals and side covers in accordance with an embodiment of the invention.

In one embodiment of the invention as best shown in FIG. 3, the bearings utilize metallic side seals 61 to reduce the risk of early pump failure by providing better bearing protection and grease retention than the seals used in prior art systems. In addition, the bearings 34, 36, also utilize metal side covers 60 on each side of each bearing 34, 36, such as those produced by SKF under the trademark NILOS®. The combination of the metallic side seals 61 and metallic side covers 60 provide further bearing protection that either would alone. The result is further bearing protection, greater lubricant retention, and longer bearing life. Bearing 34 includes an outer race 62 fixed within the housing 12 and an inner race 64 mounted on the shaft 14. Bearing 36 has an outer race 66 carried in the housing and an inner race 68 mounted on the shaft 14. The side covers 60 are thin protective rings that are designed to lay flat next to the inner race 64, 68 of the bearing 34, 36 while the outer edge of the side cover 60 rests in a perpendicular fashion on the outer race 62, 66 of the bearing 34, 36. In operation, the side cover 60 is designed to etch small groove in the outer race 62, 66 of the bearing 34, 36. The result is an added layer of protection to the bearings 34, 36 against foreign materials which have been shown to cause damage and excessive wear to the bearing.

Figure 4:
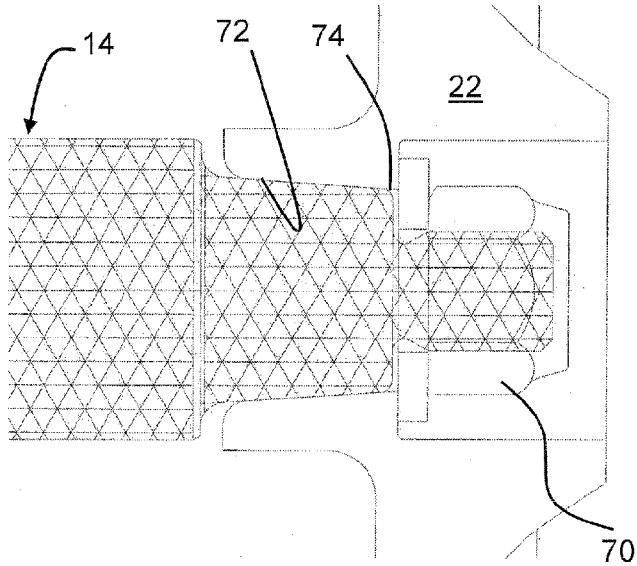
FIG. 4 is a partial, detail, cross-sectional view of the impeller/shaft connection in accordance with an embodiment of the invention.

In the prior art water pumps, the impeller is mounted on shaft such that an inside cylindrical diameter registers on a corresponding outer cylindrical diameter of the shaft. The impeller is coupled to the shaft by a key positioned in a keyway slot in the shaft and the impeller. The slot weakens the structural integrity of both components and may result in a stress related failure mode of the pump. In an embodiment of the invention as shown in FIG. 4, the shaft 14 is formed with a tapered outer diameter 72 and the impeller 22 is formed with a corresponding tapered inner diameter 74. A locking nut 70 clamps the impeller 22 onto the shaft 14 in a manner securely coupling the components and preventing slip of the impeller 22 under load. Accordingly, elimination of the keyway in this embodiment retains the inherent structural integrity of the impeller 22 and shaft 14. The shaft 14 may include other dimensional changes to provide additional bearing surface for the inner race 68 of bearing 36 and to address changes in stack-up requirements for pump system 10 as compared to particular existing prior art pump systems.

Improvements to the water pump have been disclosed. In particular, improvements to the water seal assembly, support housing, bearing features, shaft, reduced spring preload, and impeller have been provided. Initial field testing has shown significant improvement over the existing prior art water pump performance confirming that a water pump having an extended operating life with reduced need for repair is provided by the present invention.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

the invention claimed is:

1. A water pump of the centrifugal type adapted for use in diesel engine cooling systems, the water pump comprising:

a housing operable in an oil lubricated engine enclosure containing a shaft rotatable on an axis extending through the housing, the shaft mounting a drive member adjacent a drive end of the housing and a fluid impeller at an opposite impeller end of the housing, the housing having a bearing housing portion adapted to prevent engine oils from entering the bearing housing portion;

a volute connected with the impeller end of the housing for receiving pressurized water from the impeller;

a rotating seal member mounted on the shaft and rotating with the shaft; and a stationary seal member mounted on a holder member, the holder member affixed to the housing.

2. The water pump of claim 1, wherein the stationary seal and the rotating member are made of silicon carbide and the stationary seal and the rotating seal are impregnated with lubricant material.

3. The water pump of claim 1, wherein an o-ring seal is positioned between the stationary seal and the holder member.

4. The water pump of claim 1 further comprising bearings rotatably supporting the shaft in the housing, the bearings having metallic side seals on each side of the bearings.

5. The water pump of claim 4, wherein the bearings have metallic side covers on each side of the bearing and positioned outward of the metallic side seals.

6. The water pump of claim 5, wherein the sealed bearings are protected by side covers which are NILOS® rings.

7. The water pump of claim 1 further comprising a pin coupling the stationary seal to the holder member.

8. A centrifugal type fluid pump adapted for installation at least partially within an oil lubricated engine enclosure, the fluid pump comprising:

a housing operable in the oil lubricated engine enclosure containing a shaft rotatable on an axis extending through the housing, the shaft mounting a drive member adjacent a drive end of the housing and a fluid impeller at an opposite impeller end of the housing, the housing having a bearing housing portion adapted to prevent engine oils from entering the bearing housing portion;

a volute connected with the impeller end of the housing for receiving pressurized water from the impeller;

a rotating seal member mounted on the shaft and rotating with the shaft; and a stationary seal member mounted on a holder member, the holder member affixed to the housing.

9. The fluid pump of claim 8, wherein the stationary seal and the rotating member are made of silicon carbide and at least one of the stationary seal and the rotating seal is impregnated with lubricant material.

10. The fluid pump of claim 8, wherein an o-ring seal is positioned between the stationary seal and the holder member.

11. The fluid pump of claim 8 further comprising bearings rotatably supporting the shaft in the housing, the bearings having metallic side seals on each side of the bearings.

12. The fluid pump of claim 11, wherein the bearings have metallic side covers on each side of the bearing and positioned outward of the metallic side seals.

13. The fluid pump of claim 12, wherein the sealed bearings are protected by side covers which are NILOS® rings.

14. The fluid pump of claim 8 further comprising a pin coupling the stationary seal to the holder member.

* * * * *